US006539554B1

(12) United States Patent
Portela

(10) Patent No.: US 6,539,554 B1
(45) Date of Patent: Apr. 1, 2003

(54) DISPOSABLE BOXER SHORTS

(76) Inventor: Maria T. Portela, 2496 SW. 17th Ave., #5112, Miami, FL (US) 33145

( * ) Notice: Subject to any disclaimer, the term of this patent is extended or adjusted under 35 U.S.C. 154(b) by 0 days.

(21) Appl. No.: 10/059,812

(22) Filed: Jan. 29, 2002

Related U.S. Application Data

(63) Continuation-in-part of application No. 09/801,884, filed on Mar. 8, 2001, now abandoned.

(51) Int. Cl.[7] ..... A41B 9/00
(52) U.S. Cl. ..... 2/400; 2/403; 2/405
(58) Field of Search ..... 2/238, 228, 400, 2/403, 405, 406, 401, 402, 227, 69, 78.1–78.3, 114, 46; 604/385.01, 385.04, 385.19, 385.201, 385.24, 385.25, 385.28, 385.29, 385.3; 602/67–72

(56) References Cited

U.S. PATENT DOCUMENTS 2,037,060 A * 4/1936 Black ..... 2/400
3,418,660 A * 12/1968 Shumate ..... 2/400
3,611,443 A * 10/1971 Braun ..... 2/400
4,327,448 A * 5/1982 Lunt ..... 2/404
4,698,855 A * 10/1987 Hicks ..... 2/402
4,745,636 A 5/1988 Lunt

* cited by examiner

*Primary Examiner*—Gloria M. Hale
(74) *Attorney, Agent, or Firm*—Jack Lo

(57) ABSTRACT

A pair of disposable boxer shorts is comprised of a back panel, a right front panel, and a left front panel made of a strong tissue paper. The back panel has a crotch between leg portions. Each front panel has a leg portion with a half crotch along an inside edge. The shorts are made by folding down and securing the top edges of all the panels, folding and pressing the inside edge of the left front panel, joining the lower portions of the inner edges of the left and right panels with a seam to form a fly above the seam, securing the edges of the half crotches on the front panels to the corresponding edges of the crotch on the back panel, attaching the front panels to the back panel at the sides, and attaching adhesive strips to the front panels at the waist.

3 Claims, 3 Drawing Sheets

DISPOSABLE BOXER SHORTS

CROSS REFERENCE TO RELATED APPLICATIONS

This is a continuation-in-part of application Ser. No. 09/801,884 filed on Mar. 8, 2001 now abandoned.

BACKGROUND OF THE INVENTION

1. Field of the Invention

This invention relates generally to disposable garments.

2. Prior Art

The need for clean underwear is almost universal. Most people prefer to change into clean underwear at least once a day, and more frequently in hot and humid areas that promote perspiration. Preparing clean underwear is usually not a problem at home, but it may be very inconvenient when traveling, camping, etc.

Many types of disposable underwear have been disclosed in the prior art. For example, U.S. Pat. No. 4,745,636 to Lunt discloses a disposable brief comprised of a single panel folded at the crotch and connected at the sides. It has no fly, which makes urinating inconvenient. The waist has no opening, so that entry is also inconvenient. Further, the flat crotch area does not provide enough room for comfort.

BRIEF SUMMARY OF THE INVENTION

A pair of disposable boxer shorts is comprised of a back panel, a right front panel, and a left front panel made of a strong tissue paper. The back panel has a crotch between leg portions. Each front panel has a leg portion with a half crotch along an inside edge. The shorts are made by folding down and securing the top edges of all the panels, folding and pressing the inside edge of the left front panel, joining the lower portions of the inner edges of the left and right panels with a seam to form a fly above the seam, securing the edges of the half crotches on the front panels to the corresponding edges of the crotch on the back panel, attaching the front panels to the back panel at the sides, and attaching adhesive strips to the front panels at the waist.

DETAILED DESCRIPTION OF THE INVENTION

Figure 1:
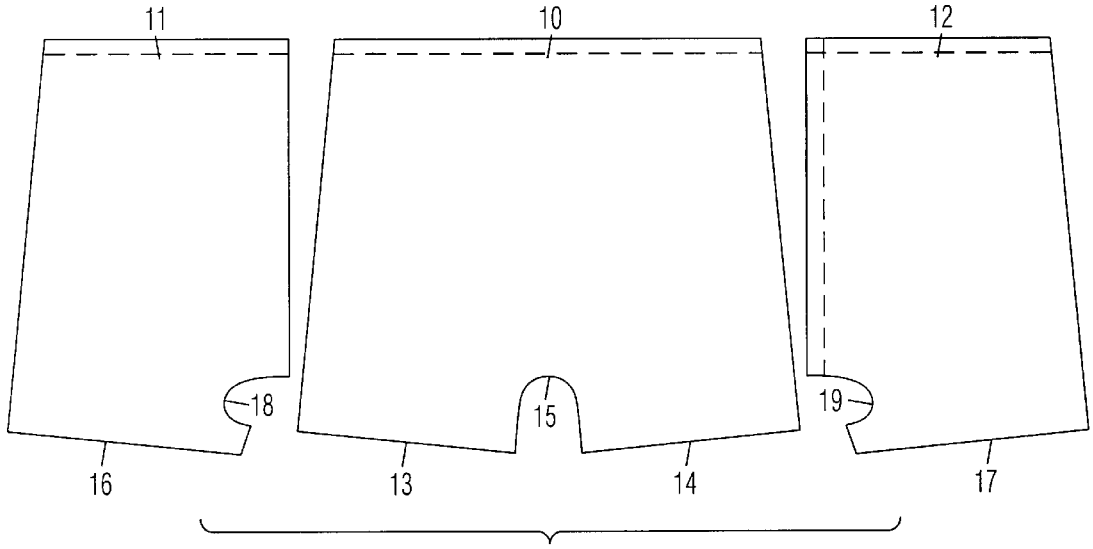
FIG. 1 is an exploded front view of the present disposable boxer shorts.

A preferred embodiment of the present disposable boxer shorts is shown in an exploded front view in FIG. 1. It is comprised of a back panel 10, a right front panel 11, and a left front panel 12, all made of a strong cloth-like paper, such as the material used for making the paper towel sold under the trademark "VIVA" by the Kimberly Clark company. Back panel 10 has leg portions 13 and 14 with an arch shaped crotch 15 in between. Front panels have leg portions 16 and 17 with right and left half crotches 18 and 19 along an inside edge that has a substantially different shape than a corresponding side of crotch 15 on back panel 10. Specifically, the edges of half crotches 18 and 19 are substantially longer than the corresponding edges of crotch 15. The panels are folded about the dashed lines during assembly, which is shown in FIGS. 2–7.

Figure 2:
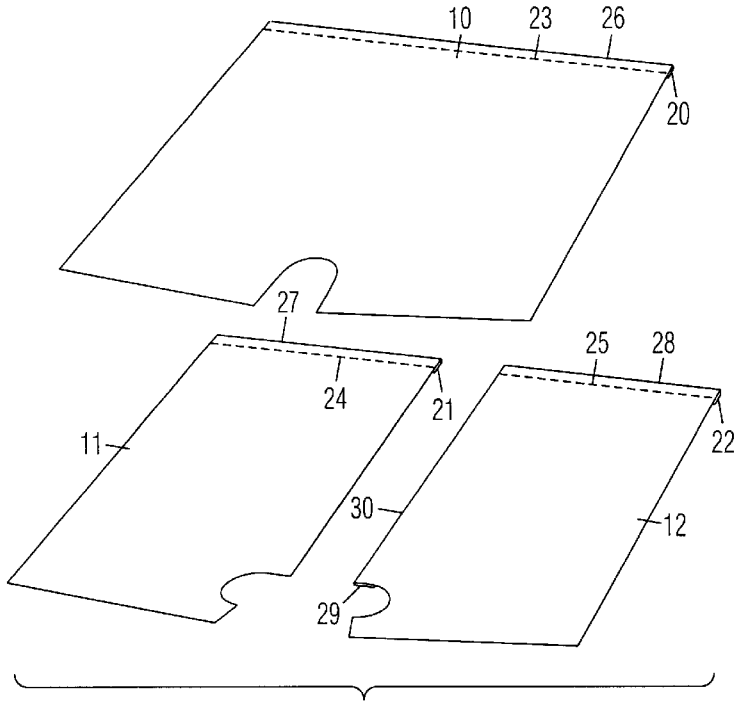
FIG. 2 is a perspective view thereof during assembly.

In FIG. 2, top edges of 20–22 of back panel 10, front panel 11, and left panel 12 are folded along the dashed lines in FIG. 1 and secured with stitches or a seam 23–25 to form waist portions 26–28. An inner edge 29 of left panel 12 is folded to form a folded edge 30.

Figure 3:
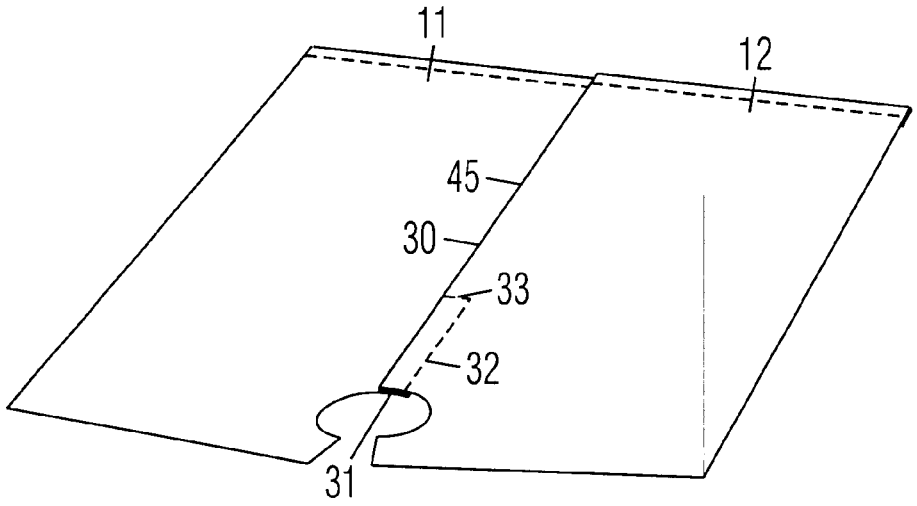
FIG. 3 is a perspective view thereof during assembly.

In FIG. 3, which shows the exterior sides of panels 11 and 12, folded edge 30 of left panel 12 is placed in an overlapping position on a non-folded inner edge of right panel 11. A strong, external vertical seam 32 and a strong, external transverse seam 33 are stitched to the lower portion of the overlap between panels 11 and 12. An outer edge of a fly 45 is defined above seam 33.

Figure 4:
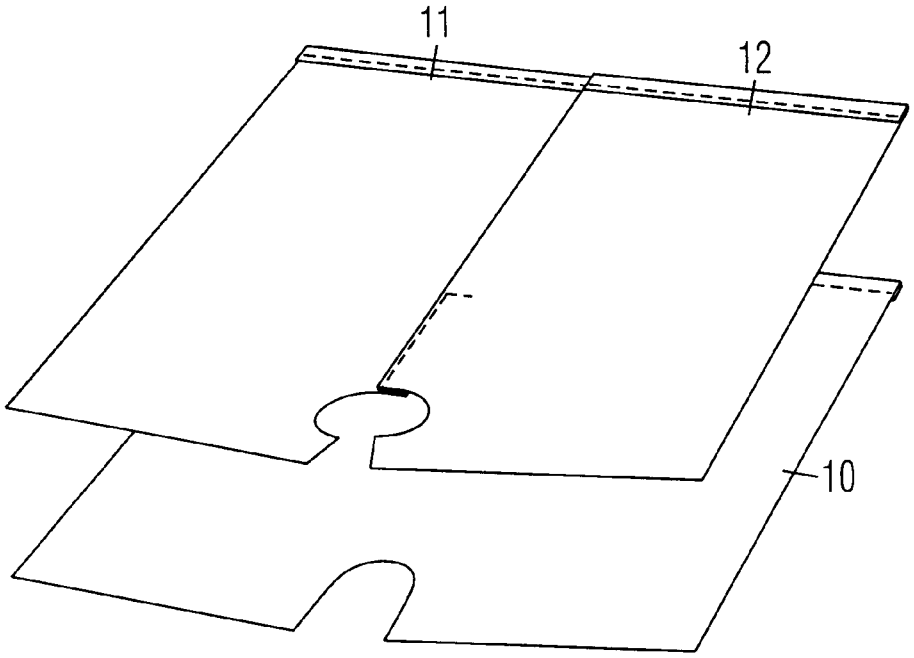
FIG. 4 is a perspective view thereof during assembly.
Figure 5:
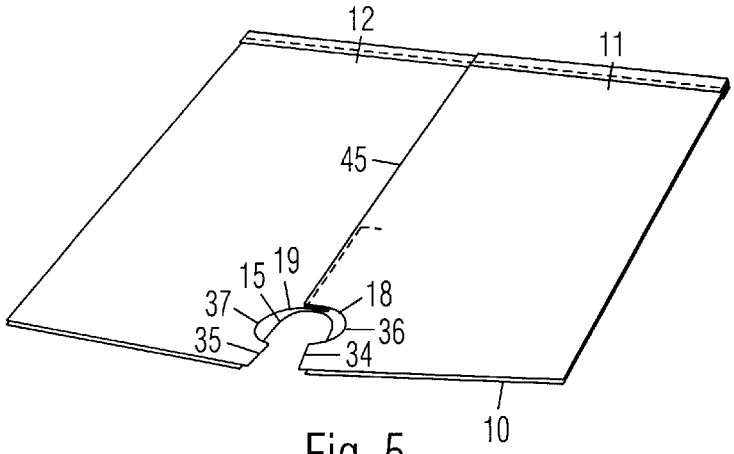
FIG. 5 is a perspective view thereof during assembly.
Figure 6:
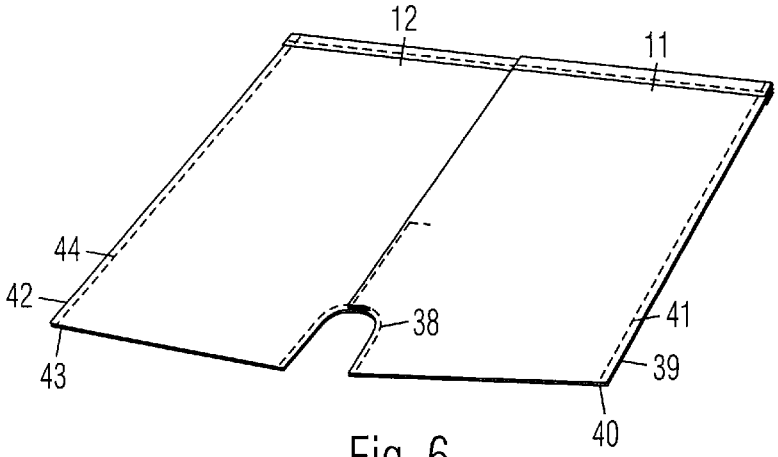
FIG. 6 is a perspective view thereof during assembly.

In FIGS. 4–5, right panel 11 and left panel 12 are reversed to position their inner sides upward, and placed on top of back panel 10, which is turned to place its inner side downward. As shown in FIG. 5, crotch 15 on the back panel is purposely mismatched in shape with half crotches 18 and 19 on the front panels. Lower edges 34 and 35 of half crotches 18 and 19 on the front panels are aligned with and stitched to the lower ends of crotch 15, and the arched upper edges 36 and 37 are "eased" to match the contour of crotch 15 as the crotch is secured with a seam 38, as shown in FIG. 6. Half crotches 18 and 19 are substantially longer than the corresponding edges of crotch 15, so that when they are eased together, they form a bulging and roomy crotch area. Outer sides 39 and 40 of right panel 11 and back panel 10 are joined by seams 41, and outer sides 42 and 43 of left panel 12 and back panel 10 are joined by a seam 44.

Figure 7:
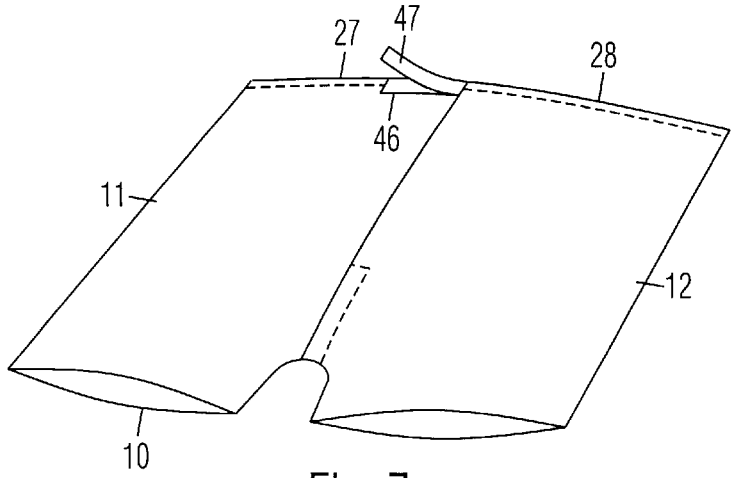
FIG. 7 is a perspective view thereof when finished.

In FIG. 7, the shorts are turned outside out. A right adhesive strip 46 is attached to waist portion 27 on right panel 11. A left adhesive strip 47 is attached to waist portion 28 on left panel 12 and projecting therefrom in a position to meet adhesive strip 46 for adjusting the waist size on a wearer. The adhesive strips may be comprised of pressure sensitive adhesive, hook-and-loop fasteners, etc. If they are pressure sensitive adhesive, they should be provided with peel-off paper covers.

Although the foregoing description is specific, it should not be considered as a limitation on the scope of the invention, but only as an example of the preferred embodiment. Many variations are possible within the teachings of the invention. For example, different attachment methods, fasteners, materials, dimensions, etc. can be used unless specifically indicated otherwise. The relative positions of the elements can vary, and the shapes of the elements can vary. Therefore, the scope of the invention should be determined by the appended claims and their legal equivalents, not by the examples given.

I claim:

1. A disposable boxer shorts, comprising:

a back panel with a pair of leg portions and an arch shaped crotch between said leg portions, wherein said back panel is comprised of a paper material;

a right front panel with a right edge connected to a right edge of said back panel, wherein said right front panel is comprised of said paper material;

a right half crotch on an inner edge of said right front panel joined to a right side of said crotch on said back panel;

a left front panel with a left edge connected to a left edge of said back panel, wherein said left front panel is comprised of said paper material;

a left half crotch on an inner edge of said left front panel joined to a left side of said crotch on said back panel;

an overlap between said inner edge of said right front panel and said inner edge of said left front panel;

a seam joining a lower portion of said overlap between said right front panel and said left front panel, said seam comprising a vertical lower portion and an upper portion extending between said lower portion and an edge of said overlap;

a fly defined along said overlap above said seam;

a right adhesive strip attached along an upper edge of said right front panel; and a left adhesive strip attached along an upper edge of said left front panel.

2. The disposable boxer shorts of claim 1, wherein said right half crotch on said right front panel and said left half crotch on said left front panel are substantially longer than respective edges of said crotch on said back panel to form a bulging and roomy crotch.

3. A method for making a pair of disposable boxer shorts, comprising:

folding and securing an upper edge of a paper back panel with a pair of leg portions and an arch shaped crotch between said leg portions;

folding and securing an upper edge of a paper right front panel with a right half crotch along an inner edge thereof;

folding and securing a top edge of a paper left front panel with a left half crotch along an inner edge thereof;

overlapping said inner edge of said right panel with said inner edge of said left panel;

joining a lower portion of an overlap between said inner edge of said right front panel and said inner edge of said left front panel with a seam to define a fly above said seam, wherein said seam comprises a vertical lower portion and a transverse upper portion extending between said vertical lower portion and an edge of said overlap;

joining said right half crotch on said right front panel and said left half crotch on said left front panel to respective edges of said crotch on said back panel, wherein said right half crotch and said left half crotch are substantially longer than said respective edges of said crotch on said back panel to form a bulging and roomy crotch area for comfort;

joining a right edge of said right front panel to a right edge of said back panel;

joining a left edge of said left front panel to a left edge of said back panel;

attaching a right adhesive strip attached along an upper edge of said right front panel; and attaching a left adhesive strip attached along an upper edge of said left front panel.

* * * * *